US007837033B2

(12) United States Patent
Schein et al.

(10) Patent No.: US 7,837,033 B2
(45) Date of Patent: Nov. 23, 2010

(54) MAGNETIC STORAGE DEVICE AND A METHOD OF ASSEMBLING THE DEVICE

(75) Inventors: Thomas P. Schein, Appleton, WI (US); Brent J. Grinwald, Appleton, WI (US)

(73) Assignee: All About Packaging, Inc., Appleton, WI (US)

( * ) Notice: Subject to any disclaimer, the term of this patent is extended or adjusted under 35 U.S.C. 154(b) by 0 days.

(21) Appl. No.: 12/384,827

(22) Filed: Apr. 9, 2009

(65) Prior Publication Data

US 2010/0258464 A1 Oct. 14, 2010

(51) Int. Cl.
*B65D 85/20* (2006.01)
*A47F 7/00* (2006.01)

(52) U.S. Cl. ..... 206/350; 206/372; 206/378; 206/443; 206/818; 211/70.6; 211/DIG. 1

(58) Field of Classification Search ..... 206/350, 206/369–370, 372, 378, 443, 508, 526, 818; 211/70.6, DIG. 1; 335/285
See application file for complete search history.

(56) References Cited

U.S. PATENT DOCUMENTS 2,893,564 A 7/1959 Gearhart
3,059,767 A 10/1962 Chalfin
3,197,915 A 8/1965 Staver
3,248,167 A 4/1966 Friedman
3,405,377 A 10/1968 Pierce
3,500,364 A * 3/1970 David ..... 283/81
3,598,900 A 8/1971 Drake
3,654,047 A 4/1972 Berkowitz
4,043,453 A 8/1977 Greenlee
4,096,581 A 6/1978 Carlo et al.
4,306,862 A * 12/1981 Knox ..... 206/63.5

(Continued)

FOREIGN PATENT DOCUMENTS

WO 03040659 5/2003

OTHER PUBLICATIONS

NEXTAG, Mechanics Time Saver (MTS728) 1/4 in. Drive Magnetic Black Socket Holder 4-14mm, website, www.nextag.com/Machanics-Time-Saver-MTS728-556441807/prices-html, printed Feb. 25, 2009, 1 page.

(Continued)

*Primary Examiner*—Bryon P Gehman
(74) *Attorney, Agent, or Firm*—Thomas J. Connelly; Wilhem Law, S.C.

(57) ABSTRACT

A magnetic storage device and a method of assembling the device are disclosed. The magnetic storage device includes a tray, a base and a magnetic member. The tray has a lower surface with a hollow area, and an upper surface. The upper surface has an upwardly extending member with a plurality of cavities formed therein. Each cavity is configured to enable one of a plurality of products to be at least partially retained therein. The base is designed to engage with the tray to completely enclose the hollow area. The magnetic member is sized and configured to be positioned within the hollow area. The magnetic member is capable of exerting a magnetic attraction to temporarily retain the plurality of products in the cavities and exerts a magnetic attraction through the base to releasably attach the magnetic storage device to a magnetically attractive surface.

20 Claims, 7 Drawing Sheets

U.S. PATENT DOCUMENTS

| | | | | | |
|---|---|---|---|---|---|
| 4,353,465 | A | | 10/1982 | Rado | |
| 4,421,230 | A | | 12/1983 | Stanton | |
| 4,482,049 | A | | 11/1984 | Kot, II | |
| 4,844,263 | A | * | 7/1989 | Hadtke | 206/508 |
| 5,025,966 | A | | 6/1991 | Potter | |
| 5,056,661 | A | | 10/1991 | Balzano | |
| 5,071,004 | A | | 12/1991 | Rivera | |
| 5,080,230 | A | | 1/1992 | Winnard | |
| 5,195,538 | A | * | 3/1993 | Eldridge et al. | 206/370 |
| 5,301,822 | A | | 4/1994 | Coleman et al. | |
| 5,344,012 | A | | 9/1994 | Matthews | |
| 5,460,305 | A | | 10/1995 | Ahearn | |
| 5,500,631 | A | | 3/1996 | Negus | |
| 5,526,927 | A | | 6/1996 | McLemore | |
| 5,560,480 | A | | 10/1996 | Singleton | |
| 5,660,276 | A | * | 8/1997 | Winnard | 206/350 |
| 5,669,516 | A | | 9/1997 | Horn | |
| 5,743,394 | A | | 4/1998 | Martin | |
| 6,047,824 | A | | 4/2000 | Winnard | |
| 6,193,577 | B1 | | 2/2001 | Kaplan | |
| 6,443,305 | B1 | | 9/2002 | Stanford et al. | |
| 6,571,669 | B2 | * | 6/2003 | Benatz et al. | 206/350 |
| 2007/0074985 | A1 | | 4/2007 | Evans | |

OTHER PUBLICATIONS

Snap-On Tools, Magnetic Socket Trays, website, www.buy1.snapon.com/catalog/tools.asp?tool=storage&Group_ID=3221 &store=snapon-st..., printed Feb. 25, 2009, 1 page.

Google, Image search for Magnetic Socket Tray, website, www.images.google.com/images?sourceid=navclient &rlz=1T4HPNW_enUS314US314&..., printed Feb. 25, 2009, 2 pages.

The Magnetic Blog, Magnets for Packaging Closures, website, www.everythingmagnetic.com/2009/01/magnets-for-packaging-closures/, printed Feb. 25, 2009, 2 pages.

* cited by examiner

MAGNETIC STORAGE DEVICE AND A METHOD OF ASSEMBLING THE DEVICE

FIELD OF THE INVENTION

This invention relates to a magnetic storage device capable of retaining a plurality of products each having a magnetic affinity. A method of assembling the magnetic storage device is also taught.

BACKGROUND OF THE INVENTION

Today, there are many different types of magnetic storage devices that are used to hold a plurality of products. Some such storage devices include a magnetic strip or a plurality of spaced apart magnetic discs used to attach the storage device to a magnetically attractive surface. Examples of such devices are taught in U.S. Pat. No. 5,460,305 issued to Ahearn, and U.S. Pat. No. 5,056,661 issued to Balzano. The magnetically attractive surface can be a metal wall, a ferrous surface of a motor vehicle, a metal cabinet, a metal tool box, the metal part of a work bench, etc. Such storage devices usually have a plurality of pockets, openings, clips, sleeves, etc. into which one or more individual products can be inserted. The products can vary in type, kind and design. The products can includes tools including but not limited to: different size wrenches, screwdrivers, various size socket heads which can be sequentially attached to a socket wrench, drills, drill bits, any tool having a stem or a shank, etc. The products can also include sporting goods, such as fishing lures, fishing hooks, fly fishing lures, hunting accessories, dental tools, small parts, etc. The total number of products capable of being held in such storage devices can vary from a few items to many items.

Other storage devices are also known which utilize one or more magnets to temporarily hold a plurality of products, each constructed from a ferrous metal and having a magnetic affinity, to the storage device. In these storage devices, one or more magnetic strips or discs are incorporated into the storage device such that they are exposed and can exert a magnetic attraction for the plurality of products inserted or placed therein. Examples of some such devices are taught in U.S. Pat. No. 2,893,564 issued to Gearhart; U.S. Pat. No. 5,025,966 issued to Potter; U.S. Pat. No. 5,080,230 issued to Winnard, and in U.S. Patent Publication 2007/0074985 to Evans.

Furthermore, there even exists some storage devices that use one or more magnetic members to temporality hold a plurality of products in place while using the same or different magnetic members to attach the storage device to a magnetically attractive surface. Examples of some of these kinds of devices are taught in U.S. Pat. No. 3,405,377 issued to Pierce; U.S. Pat. No. 5,301,822 issued to Coleman et al.; U.S. Pat. No. 5,500,631 issued to Negus; U.S. Pat. No. 5,669,516 issued to Horn and U.S. Pat. No. 5,743,394 issued to Martin.

It is well known that many mechanics and skilled craftsmen, who work on motor vehicles, such as cars, trucks, boats, trains and airplanes, or work in construction, manufacturing or building maintenance, prefer to use power tools especially power drills and power screwdrivers, where multiple size bits, socket heads, screwdriver heads, drills, etc. can be quickly and efficiently interchanged. Such power tools save time and allow the mechanic or craftsman to complete the task with the upmost of ease. Likewise, many mechanics and skilled craftsmen like to use a socket wrench where different size socket heads can be interchanged such that various size bolts and nuts can be worked on without requiring the mechanic or skilled craftsmen to constantly move from one position to another or to travel back and forth to his tool chest or tool box.

It is also well understood by many of the manufacturers of tools, especially those who sell wrenches and socket wrench heads, to sell a set consisting of a plurality of socket heads. This correlates to increase sales and profits. Each set can vary in the number of socket heads and the range of bolt heads and nuts that the socket heads will be able to attach to. In addition, some sets can be manufactured such that the socket heads will fit onto bolts and nuts manufactured to English units while other sets can include sockets manufactured to fit onto bolts and nuts manufactured to metric units. Furthermore, sets can be assembled such that all of the sockets within the set are designed to fit onto a socket wrench having a 0.25, 0.375 or 0.5 inch drive stud.

Because there are so many different kinds, types and sizes of socket headsets available today, most mechanics and skilled craftsmen own multiple sets of socket heads. In order to be able to perform their trade effectively and efficiently, they have to keep each set separate and distinct from another set. If they do not, they quickly recognize that they are spending a lot of time trying to locate the correct size socket head or one with the correct size opening to fit onto the particular socket wrench drive stud that they are going to use. Many mechanics and skilled craftsmen keep different sets of socket heads in different drawers of their tool chest or tool box to alleviate this problem. Tool manufacturers have also assisted in this endeavor by selling socket head sets in individual packages wherein the base contains a plurality of cavities, bores or openings of various diameters such that only the correct diameter socket head can be placed into its own unique site. This allows the mechanic or skilled craftsmen to quickly and easily reach for and grab the correct socket head with a single hand.

It has now been recognized that a significant cost saving can be obtained if the socket head set holder can also serve as the overall package in which the set of socket heads is sold. This will reduce packaging material and reduce waste going into our landfills. In addition, if a portion of the holder/package can be constructed from a transparent material, it can allow the purchaser to view the set of socket heads before purchase and also see each of the socket heads after purchase. Furthermore, a tool manufacturer can also affix his company name and/or logo onto the holder/package so as to keep his name in front of the tool users. This is advantageous for obtaining repeat business. Still further, if the holder/package is of a handy size, the mechanic or craftsman can place the entire holder/package into his tool chest or tool box and can remove and carry the entire holder/package over to a work site. It should also be recognized that if the holder/package contains a magnet, it can be releasably attached to the outer surface of a motor vehicle or to some other magnetically attractive surface. The magnet can also serve to temporarily retain each of the socket heads in the holder/package. Lastly, the holder/package can be designed and constructed such that two or more of the holders/packages can be stacked or nested so as to facilitate shipping and to create an aesthetically pleasing product display on a retailer's shelf.

Now a magnetic storage device has been invented which can accomplish all of the above mentioned desired features. In addition, a method of assembling a magnetic storage device has also been invented.

SUMMARY OF THE INVENTION

Briefly, this invention relates to a magnetic storage device which is capable of retaining a plurality of products each having a magnetic affinity. The magnetic storage device includes a tray, a base and a magnetic member. The tray has a lower surface with a hollow area, an upper surface, and a longitudinal central axis. The upper surface has a plateau with an outer periphery and an upwardly extending member located completely within the outer periphery. The upwardly extending member has a plurality of cavities formed therein which are aligned along the longitudinal central axis. Each of the plurality of cavities extends downward towards the lower surface, and each of the plurality of cavities has a configuration which enables one of the pluralities of products to be at least partially retained therein. The base has a lower surface and an upper surface. At least a portion of the upper surface of the base engages with the tray to completely enclose the hollow area. The magnetic member is sized and configured to be positioned within the hollow area. The magnetic member exerts a sufficient magnetic attraction on the plurality of products when each is inserted into one of the plurality of cavities to temporarily retain the plurality of products therein. The magnetic member also exerts a sufficient magnetic attraction through the lower surface of the base to releasably attach the magnetic storage device to a magnetically attractive surface.

A method of assembling the magnetic storage device is also taught. The method includes the steps of forming a tray having a lower surface with a hollow area, an upper surface, and a longitudinal central axis. The upper surface has a plateau with an outer periphery and an upwardly extending member located completely within the outer periphery. The upwardly extending member has a plurality of cavities formed therein which are aligned along the longitudinal central axis. Each of the plurality of cavities extends downward towards the lower surface and each of the plurality of cavities has a configuration which enables one of the pluralities of products to be at least partially retained therein. The method also includes forming a base having a lower surface and an upper surface. At least a portion of the upper surface of the base engages with the tray to completely enclose the hollow area. The method further includes positioning a magnetic member within the hollow area and aligning the base with the tray to allow the upper surface of the base to engage the hollow area and enclose the magnetic member.

The general object of this invention is to provide a magnetic storage device capable of retaining a plurality of products each having a magnetic affinity. A more specific object of this invention is to provide a method of forming the magnetic member.

Another object of this invention is to provide a magnetic storage device which can retain a plurality of products while mounted in any orientation, even when inverted.

A further object of this invention is to provide a magnetic storage device that can hold a plurality of products and also serve as a package in which the plurality of products can be sold.

Still another object of this invention is to provide a magnetic storage device which can retain a set of various products each having a magnetic affinity, such as wrenches, socket wrench heads, drills, drill bits, etc.

Still further, an object of this invention is to provide a magnetic storage device that can be easily and economically manufactured.

Other objects and advantages of the present invention will become more apparent to those skilled in the art in view of the following description and the accompanying drawings.

DETAILED DESCRIPTION OF THE INVENTION

Figure 1:
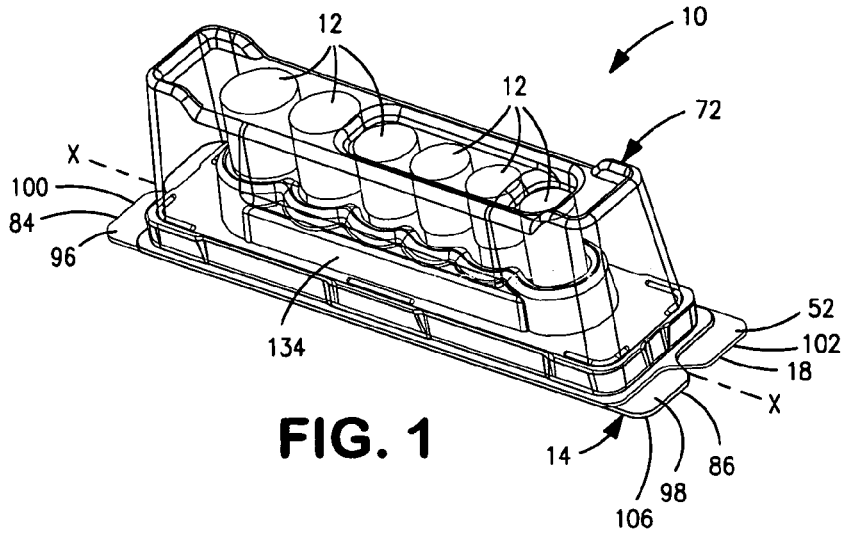
FIG. 1 is a perspective view of a magnetic storage device.

Referring to FIGS. 1-4, a magnetic storage device 10 is depicted which is capable of holding, retaining, organizing and storing a plurality of products 12. In other words, the plurality of products 12 can be kept as a set. Each of the plurality of products 12 should have an affinity for a magnetic charge. By "product" it is meant any article, item or substance produced by human or mechanical effort or by a natural process, including a substance resulting from a chemical reaction. The products 12 can vary in type, kind, shape and construction. The products 12 can be built for a single use or for repeated use. The products 12 could be formed, molded, manufactured, assembled and/or constructed such that at least a portion of each product 12 is formed from or contains a metal such as iron or a metal oxide. Each product 12 could also contain a ferric or ferrous substance, include ferrous oxide or some other metal oxide, or be ferromagnetic. By "ferric" it is meant of or relating to, or containing iron, especially with a valence of 3 or a valence higher than in a corresponding ferrous compound. By "ferrous" it is meant of or relating to, or containing iron, especially with a valence of 2 or a valence lower than in a corresponding ferric compound.

Each of the plurality of products 12 has a magnetically attractive portion or surface. Desirably, each of the plurality of products 12 is constructed partially or totally out of metal. The amount of metal contained in each of the plurality of products 12 will be at least about 25%. Desirably, the amount of metal contained in each of the plurality of products 12 will range from between about 30% to about 100%. More desirably, the amount of metal contained in each of the products 12 will range from between about 50% to about 100%. Even more desirably, the amount of metal contained in of each of the plurality of products 12 will range from between about 75% to about 100%.

The magnetic storage device 10 can include various products 12 including but not limited to: tools, such as wrenches, socket heads which can be connected to a socket wrench, drills, drill bits, screwdrivers, screwdriver bits, pliers, tools having a stem or a shank, or any other kind of tool. The magnetic storage device 10 can also include kitchen utensils; small parts, sporting goods such as hunting and fishing accessories, bullets, shotgun shells, fishing lures, fishing hooks, fishing flies, etc.; items needed for a particular hobby; items associated with a particular activity or interest; items needed to perform one's professional job, such as medical or dental instruments; items needed to make or repair equipment such as jewelry components; figurines such as toy metal soldiers; tie clips; bow ties or any article or item that includes a metal or iron part. Typically, one or more products 12 will be packaged in a single magnetic storage device 10. Desirably, two or more products 12 will be packaged in a single magnetic storage device 10. Even more desirably, several products 12 will be packaged in a single magnetic storage device 10. Most desirably, a plurality of products 12 will be packaged in a single magnetic storage device 10. The actual number of products 12 retained in a single magnetic storage device 12 can vary from one product 12 to many products 12. In some instances, a single magnetic storage device 12 can hold over a thousand products 12 depending upon the size and configuration of the particular products 12.

The magnetic storage device 10 can be constructed from one or more materials. Such materials include but are not limited to: plastics such as polyethylene, polypropylene or a combination thereof, thermoplastics, clear plastics, transparent plastic, colored plastics, metal or a metal alloy, aluminum or an aluminum alloy, glass, fiberglass, wood, plywood, paper, paperboard, cardboard, veneer, a composite material, etc. Desirably, a portion of the magnetic storage device 10 is constructed from a clear or transparent plastic so that the plurality of products 12 retained therein is visible to the naked eye.

Referring now to FIGS. 5-8, the magnetic storage device 10 is a 3-dimensional structure having a longitudinal central axis X-X, a transverse central axis Y-Y and a vertical central axis Z-Z. The magnetic storage device 10 includes a tray 14 which is also a 3-dimensional member having a longitudinal central axis $X_1$-$X_1$, a transverse central axis $Y_1$-$Y_1$ and a vertical central axis $Z_1$-$Z_1$. The tray 14 can be formed into a variety of sizes and configurations. Desirably, the tray 14 is an elongated member having a first end 16, a second end 18, a first side 20 and a second side 22. More desirably, the tray 14 has a generally rectangular configuration. The tray 14 can be formed or constructed from a wide variety of materials. Desirably, the tray 14 is formed or molded from a plastic or thermoplastic material. The tray 14 can be formed in a variety of colors or be white in color. A solid color like red, blue, green, yellow or black works well but the tray 14 can also be multicolored, if desired. The tray 14 can be colored to match the colors of a manufacturer's logo or signs or it can be made in some other color.

When the tray 14 is formed from a plastic or a thermoplastic, it can be constructed as a distinct, integral member having no moving parts. For example, the tray 14 can be injection molded. The tray 14 has a lower surface 24, best seen in FIGS. 6-8, and an upper surface 26, see FIGS. 5 and 6. The lower surface 24 has an outer periphery 28.

Figure 8:
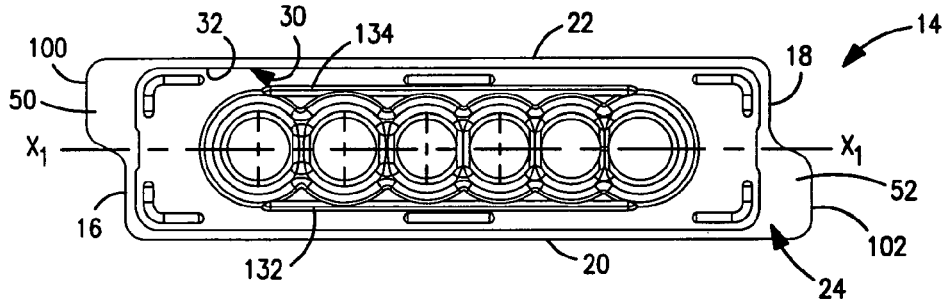
FIG. 8 is a bottom view of the tray shown in FIG. 5.

Referring to FIG. 8, a hollow area 30 is formed in the lower surface 24. By "hollow area" it is meant a cavity, gap or space within: a hollow wall; deeply indented or sunken. The hollow area 30 has an interior or inner periphery 32 which is formed inward from the outer periphery 28. The interior periphery 32 has a generally rectangular shape. The hollow area 30 causes the tray 14 to take on a shell like appearance.

Referring again to FIG. 5, the upper surface 26 of the tray 14 includes a plateau 34. By "plateau" it is meant an elevated, relatively level expanse of material. The plateau 34 has a sidewall 36 and an outer periphery 38. The sidewall 36 extends upwards from the lower surface 24. As shown, the entire outer periphery 38 of the plateau 34 is within the outer periphery 28 of the lower surface 24. Alternatively, one or more edges of the outer periphery 38 of the plateau 34 can be contiguous with one or more edges of the outer periphery 28 of the lower surface 24. By "contiguous" it is meant sharing an edge or boundary; touching.

The plateau 34 can extend upward from the lower surface 24 by any desired distance. Desirably, the plateau 34 extends upward from the lower surface 24 by a distance of from between about 0.1 inches to about 1 inch. More desirably, the plateau 34 extends upward from the lower surface 24 by a distance of from between about 0.15 inches to about 0.5 inch. Even more desirably, the plateau 34 extends upward from the lower surface 24 by a distance of from between about 0.2 inches to about 0.4 inches.

Figure 5:
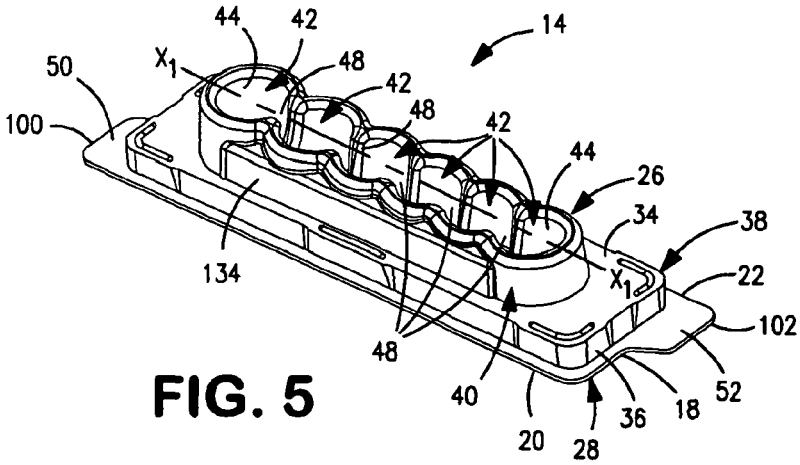
FIG. 5 is a perspective view of a tray used in the magnetic storage device.
Figure 6:
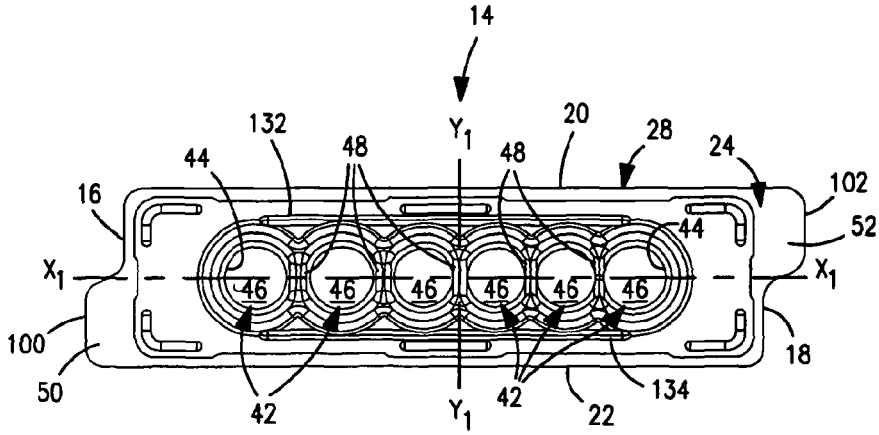
FIG. 6 is a top view of the tray shown in FIG. 5.
Figure 7:
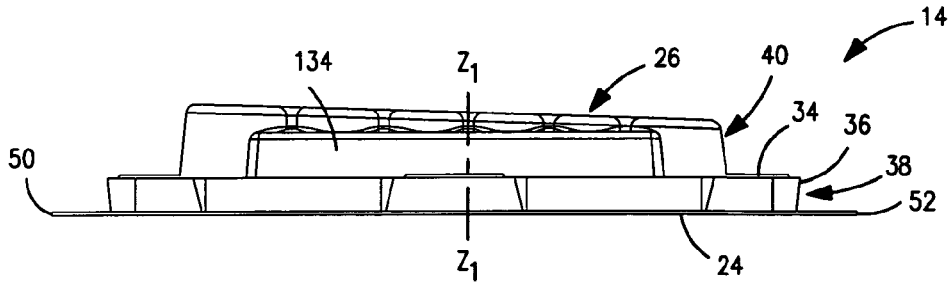
FIG. 7 is a side view of the tray shown in FIG. 5.

Still referring to FIG. 5, the sidewall 36 extends vertically upward from the lower surface 24 and is aligned parallel to the vertical central axis $Z_1$-$Z_1$. Alternatively, the sidewall 36 can be aligned at an angle to the vertical central axis $Z_1$-$Z_1$. Desirably, the sidewall 36 is aligned within an angle of ±60 degrees from the vertical central axis $Z_1$-$Z_1$. More desirably, the sidewall 36 is aligned within an angle of ±45 degrees from the vertical central axis $Z_1$-$Z_1$.

The tray 14 also has an upwardly extending member 40 located completely within the outer periphery 38 of the plateau 34. The upwardly extending member 40 can rise upward above the plateau 34 by any desired distance. Desirably, the upwardly extending member 40 rises upward above the plateau 34 by a distance of at least about 0.1 inches. More desirably, the upwardly extending member 40 rises upward above the plateau 34 by a distance of at least about 0.2 inches. Even more desirably, the upwardly extending member 40 rises upward above the plateau 34 by a distance of at least about 0.4 inches. The upwardly extending member 40 is aligned parallel to the vertical central axis $Z_1$-$Z_1$ but could be at an angle to the vertical central axis $Z_1$-$Z_1$, if desired. The upwardly extending member 40 and has one or more cavities 42 formed therein. By "cavity" it is meant a hollow, a hole, a hollow area within a body. Desirably, a plurality of cavities 42 are formed in the upwardly extending member 40. The actual number of cavities 42 can vary. The tray 14 can contain either an even number of cavities 42 or an odd number of cavities 42. Desirably, two or more cavities 42 are formed in the upwardly extending member 40. More desirably, three or more cavities 42 are formed in the upwardly extending member 40. Even more desirably, five or more cavities 42 are formed in the upwardly extending member 40. In FIG. 5, six cavities 42 are depicted. The maximum number of cavities 42 formed in the upwardly extending member 40 can range upward to a hundred or more. Desirably, the tray 14 will have from between about five to about forty cavities 42 formed therein. More desirably, the tray 14 will have from between about six to about thirty cavities 42 formed therein. Even more desirably, the tray 14 will have from between about seven to about twenty-four cavities 42 formed therein.

Referring again to FIGS. 5-8, each of the cavities 42 is aligned in a row along the longitudinal central axis $X_1$-$X_1$. In other words, each of the cavities 42 can share the same centerline. Each of the cavities 42 extends downward towards the lower surface 24. The actual interior shape of each of the cavities 42 can vary. As shown in FIG. 5, each of the cavities 42 has a sidewall 44. The sidewall 44 can form a bore having a circular cross-section. Alternatively, each of the cavities 42 can have some other geometrical cross-section, such as square, rectangular, triangular, etc. Each of the cavities 42 can have a cylindrical shape, a conical shape with a tapered sidewall 44, or some other geometrical shape. Desirably, each of the cavities 42 is a cylindrical bore with a diameter. The diameter can be constant or can vary throughout the depth of the cavity 42.

Each of the cavities 42 formed in the tray 14 is dimensioned to either loosely, snugly or tightly receive a product 12. Each of the cavities 42 can also be used to organize the plurality of products 12 according to size. The tray 14 is constructed so that a portion of each product 12 can protrude upward from each of the cavities 42 a sufficient amount. This upward protrusion allows for one-handed removal and/or replacement of the product 12 from or back into the cavities 42.

The sidewall 44 of each of the cavities 42 can be aligned parallel with the vertical central axis $Z_1$-$Z_1$ or be aligned at an angle thereto. In addition, the diameter of one of the cavities 42 can be similar to or be different from the diameter of another one of the cavities 42. In other words, each of the cavities 42 could have the same diameter or one or more of the cavities 42 could have a different diameter. Alternatively, each of the cavities 42 can have a different diameter. Since many of the products 12 which will be retained in the cavities 42 will vary in size, one or more of the cavities 42 will have a different diameter. Sometimes, two or more of the cavities 42 will have a first diameter and the remaining cavities 42 will have a second diameter. It is also possible to form the cavities 42 such that one of the cavities 42 will have a different geometrical shape relative to one or more of the remaining cavities 42. For example, one cavity 42 can have a cylindrical bore while another cavity 42 has a square bore.

Each of the cavities 42 has a closed bottom 46. Desirably, each of the closed bottoms 46 is spaced above the lower surface 24 of the tray 14. Each of the closed bottoms 46 can be spaced above the lower surface 24 of the tray 14 by any desired distance. Desirably, each of the closed bottoms 46 is spaced at least about 0.1 inches above the lower surface 24. In addition, each of the closed bottoms 46 can be aligned in a horizontal plane. The horizontal plane can be aligned parallel with the lower surface 24 of the tray 14.

Referring again to FIG. 5, the sidewall 44 of each cavity 42 will intersect with the sidewall 44 of an adjacent cavity 42. In addition, an opening 48 is formed in each of the sidewalls 44 approximately at the point of intersection. The openings 48 serve to conserve space in the magnetic storage device 10 such that more products 12 can be retained therein. In addition, the openings 48 also function to allow the material, i.e. thermoplastic material, from which the magnetic storage device 10 can be molded, to stretch during the molding process without experiencing excessive thinning.

The configuration and depth of each of the openings 48 can vary. Each of the openings 48 can have any desired geometrical configuration. For example, the openings 48 can have a V-shaped or U-shaped configuration. Each of the openings 48 can have the same configuration or have a different configuration. Each of the openings 48 can have the same depth or a different depth. Each of the openings 48 can have the same configuration and depth or have a different configuration and depth. The depth of each of the openings 48 should be at least about 50% of the depth of the respective cavity 42. Desirably, the depth of each of the openings 48 can range from between about 60% to 100% of the depth of the respective cavity 42. More desirably, the depth of each of the openings 48 can range from between about 70% to 100% of the depth of the respective cavity 42. The openings 48 formed in the sidewalls 44 function to assist a person in removing a product 12 from the respective cavity 42. Each of the openings 48 prevent a friction force from developing near the sides of each of the products 12 which could increase the amount of force needed to remove the product 12 from the cavity 42.

It should be understood that each of the cavities 42 has a configuration which enables one of the plurality of products 12 to be at least partially retained in one of the respective cavities 42. Desirably, at least about 25% of each product 12 is positioned within each of the cavities 42. More desirably, at least about 40% of each product 12 is positioned within each of the cavities 42. Even more desirably, at least about 50% of each product 12 is positioned within each of the cavities 42.

Referring again to FIGS. 5-8, one can see that the cavity 42 located adjacent to the first end 16 of the tray 14 has a height which is greater than the cavity 42 located adjacent to the second end 18 of the tray 14. Also, the upwardly extending member 40 varies in height along the longitudinal central axis $X_1$-$X_1$, see FIG. 7. The upwardly extending member 40 can taper down from one end to the opposite end, as shown, or have a stepped profile. The change in height allows the cavity 42 located closest to the first end 16 of the tray 14 to have a depth which is greater than the depth of the cavity 42 located closest to the second end 18 of the tray 14. This can be important where the product 12 positioned in the cavity 42 located adjacent to the first end 16 of the tray 14 has a larger diameter and/or is longer in length than the product 12 that is positioned in the cavity 42 located adjacent to the second end 18 of the tray 14. The extra height of the upwardly extending member 40 will allow the depth of the cavity 42 to be greater and therefore the cavity 42 will be better able to retain the larger size product 12 in a more secure fashion.

Referring again to FIGS. 5, 6 and 8, one can see that the first and second ends, 16 and 18 respectively, of the tray 14 have an arcuate or non-linear design with approximately half of each end extending outward in the form of a finger tab 50 and 52, respectively. The finger tab 50 extends outward from the remainder of the first end 16 and parallel to the longitudinal central axis $X_1$-$X_1$ while the finger tab 52 extends outward from the second end 18 and parallel to the longitudinal central axis $X_1$-$X_1$. The function of the finger tabs 50 and 52 will be explained shortly.

Figure 9:
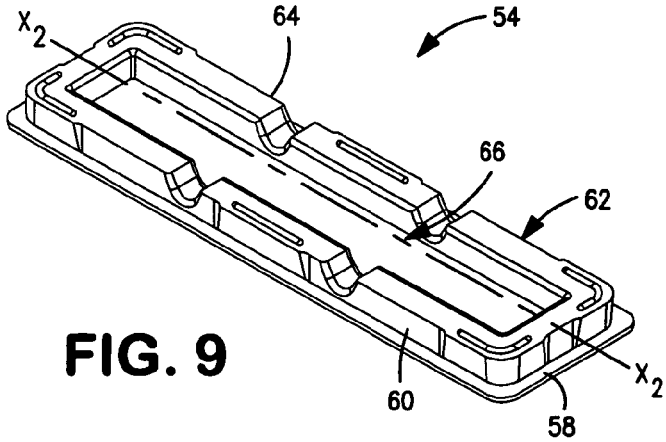
FIG. 9 is a perspective view of a base used in the magnetic storage device.
Figure 10:
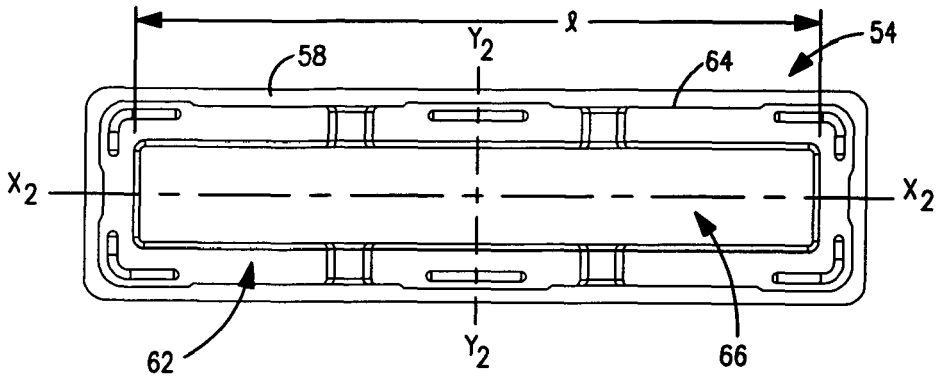
FIG. 10 is a top view of the base shown in FIG. 9.
Figure 11:
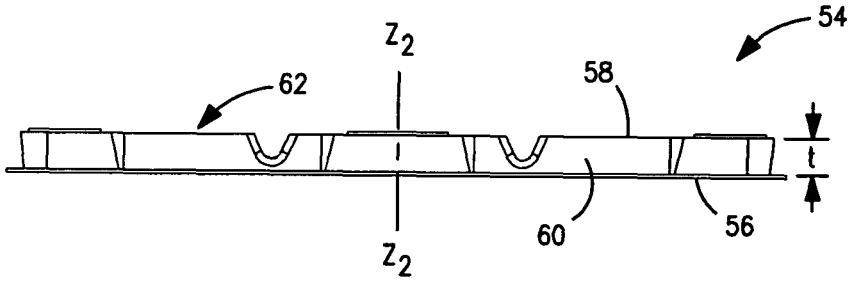
FIG. 11 is a side view of the base shown in FIG. 9.

Referring now to FIGS. 9-11, the magnetic storage device 10 also includes a base 54. The base 54 can be a flat member or a 3-dimensional structure. Desirably, the base 54 is a 3-dimensional structure having a longitudinal central axis $X_2$-$X_2$, a transverse central axis $Y_2$-$Y_2$ and a vertical central axis $Z_2$-$Z_2$. The base 54 can be formed from various non-magnetic materials including but not limited to: plastic, thermoplastic, thermosetting plastic, styrene, foam, acrylic, nylon, paperboard, cardboard, etc. The base 54 can be clear and transparent or be opaque. The base 54 can be white in appearance or be colored by adding a colorant. The base 54 can further include a filler and/or a reinforcement material, such as glass fibers, etc. to make it stronger. Desirably, the base 54 is molded from a clear plastic material. The base 54 has a lower surface 56, an upper surface 58, and a sidewall 60 which extends between the lower and upper surfaces, 56 and 58 respectively. The sidewall 60 has a thickness t which can vary in dimension. Desirably, the sidewall 60 has a thickness t which ranges from between about 0.01 inches to about 0.5 inches. More desirably, the sidewall 60 has a thickness t which ranges from between about 0.1 inches to about 0.4 inches. Even more desirably, the sidewall 60 has a thickness t which ranges from between about 0.15 inches to about 0.3 inches.

The sidewall 60 can cooperate with the upper surface 58 of the base 54 to form an elevation 62 having an outer periphery 64. The elevation 62 is sized and configured to enable a portion of the upper surface 58, i.e. the outer periphery 64, to engage with the tray 14 to completely enclose the hollow area 30. Desirably, the elevation 62 is sized and configured to engage with the interior periphery 32 of the tray 14 to completely enclose the hollow area 30.

It should be understood that the base 54 can be secured to the tray 14 by various means known to those skilled in the art. Such means include but are not limited to: using glue, using an adhesive, by welding with heat, using radio frequency or ultrasonic vibrations. It is also possible for the base 54 to be secured to the tray 14 with a frangible seal that can be broken at a later time, if desired.

Still referring to FIGS. 9 and 10, the base 54 has a recess 66 formed in its upper surface 58. The recess 66 can have any desired geometrical shape. The recess 66 is shown as an elongated recess 66 with a generally rectangular shape. The recess 66 has a length I which is less than the overall length of the base 54.

Figure 12:
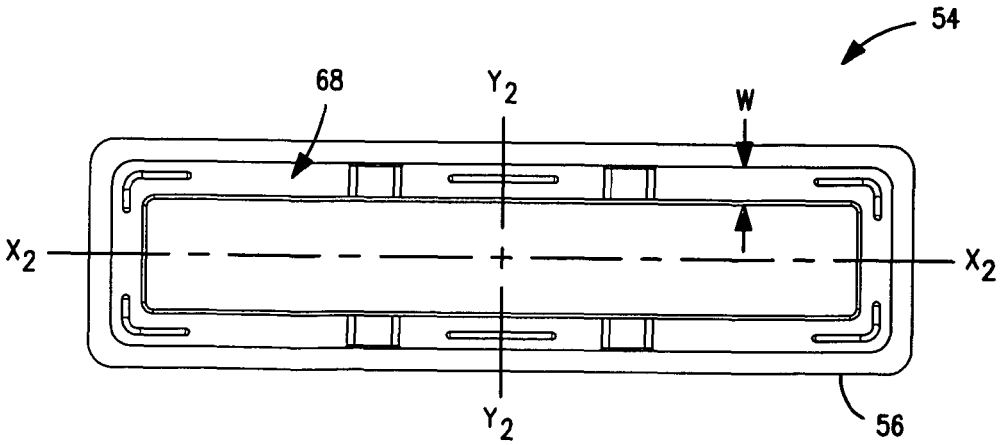
FIG. 12 is a bottom view of the base shown in FIG. 9.
Figure 19:
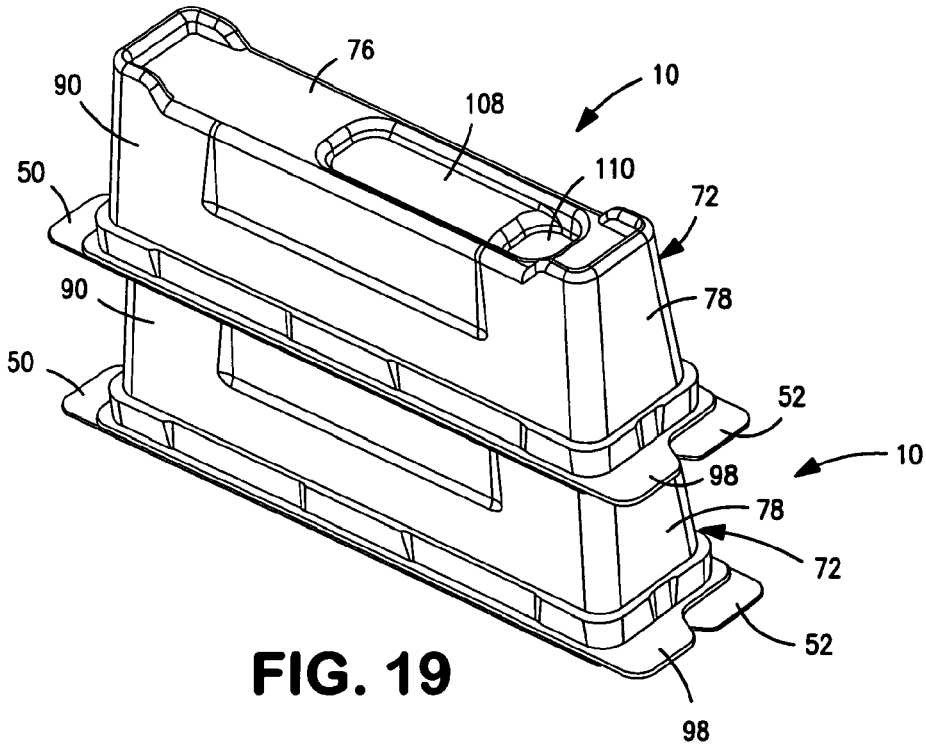
FIG. 19 is a front view of a advertising card that can be inserted into the cover to identify the products, provide information as to the manufacturer, and/or provide instructions as to how to use the products contained in the magnetic storage device.

Referring now to FIGS. 9, 12 and 19, a channel 68 is formed or molded into the lower surface 56 of the base 54. The channel 68 can completely surround the recess 66, se FIG. 9, or only partially surround the recess 66. Desirably, the channel 68 is a continuous loop which completely surrounds the recess 66. The channel 68 can have a generally rectangular configuration, as shown, when the recess 66 is rectangular in shape. If the recess 66 is circular in shape, the channel 68 can be circular in configuration. The channel 68 has a width w and depth. The width w can vary in dimension as can the depth. Desirably, the width w ranges from between about 0.1 inches to about 0.5 inches. Desirably, the width w ranges from between about 0.2 inches to about 0.4 inches. The depth can range from between about 0.1 inches to about 0.5 inches. Desirably, the depth ranges from between about 0.2 inches to about 0.4 inches. The purpose of the channel 68 is to provide a mating structure that can engage with another magnetic storage device 10 such that two or more of the magnetic storage devices 10, 10 can be stacked one upon another, see FIG. 19. By providing a nesting structure so that multiple magnetic storage devices 10 can be stacked together, one can reduce packing and shipping charges and also facilitate display of the magnetic storage devices on a retailer's shelf.

Figure 13:
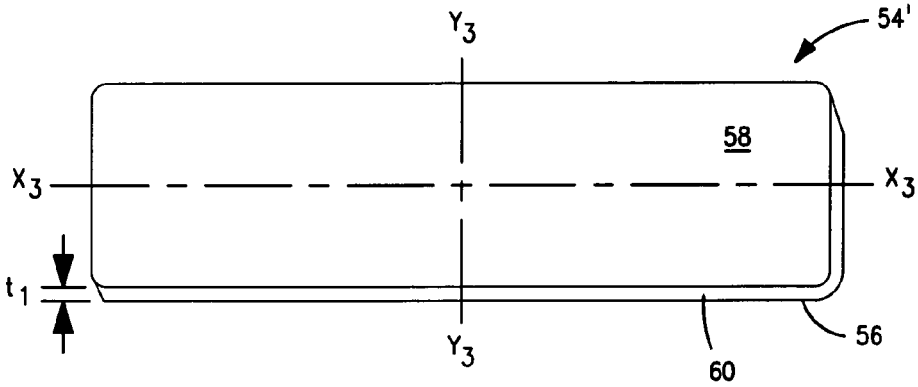
FIG. 13 is a perspective view of an alternative embodiment of a base used in the magnetic storage device.

Referring to FIG. 13, an alternative embodiment of a base 54' is shown.

The base 54' is depicted as a flat, planar member having a longitudinal central axis $X_3$-$X_3$ and a transverse central axis $Y_3$-$Y_3$. The base 54' also has a sidewall 60 with a relatively small thickness $t_1$. The thickness $t_1$ of the sidewall 60 can range from between about 0.01 inches to about 0.1 inches. Desirably, the sidewall 60 has a thickness $t_1$ ranging from between about 0.02 inches to about 0.1 inches. More desirably, the sidewall 60 has a thickness ti ranging from between about 0.03 inches to about 0.08 inches. The base 54' can be formed from various materials which include but are not limited to: stiff paper, thick paper, construction paper, paperboard, thin pasteboard, cardboard, corrugate, plastic, thermoplastic, styrene, foam, a lightweight core sandwiched between two plies of paper, etc. The base 54' is designed to be secured to the lower surface 24 of the tray 14 by any means known to those skilled in the art. For example, an adhesive could be used to secure the base 54' to the tray 14. A frangible seal could be used to secure the base 54' to the tray 14. In addition, the base 54' could be sized and configured to engage with or mate with the hollow area 30 of the tray 14. Furthermore, the base 54' could be held secure to the tray 14 by welding with heat, using radio frequency, ultrasonic vibrations or by another means known to those skilled in the art.

The base 54 and 54' provides a smooth bottom surface for the magnetic storage device 10 such that it will not scratch or otherwise damage a magnetically attractive surface onto which the magnetic storage device 10 is attached.

Figure 14:
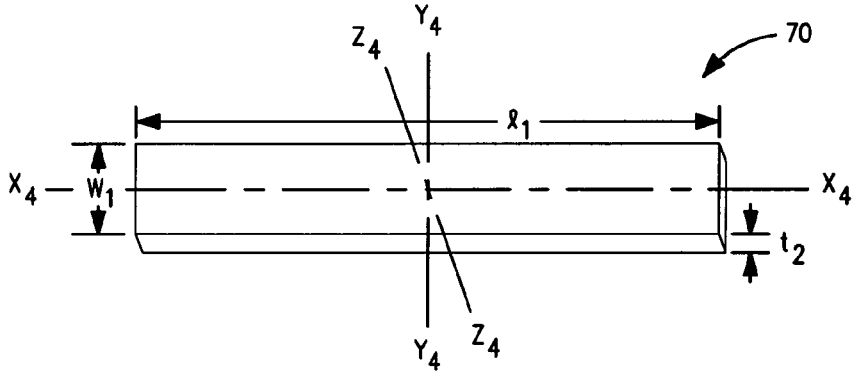
FIG. 14 is a perspective view of a magnetic member used in the magnetic storage device.

Referring to FIG. 14, the magnetic storage device 10 further includes a magnetic member 70. The magnetic member 70 is a 3-dimensional member having a longitudinal central axis $X_4$-$X_4$, a transverse central axis $Y_4$-$Y_4$, and a vertical central axis $Z_4$-$Z_4$. The magnetic member 70 is sized and configured to be positioned within the hollow area 30 of the tray 14. The magnetic member 70 can be a single magnet or a series of magnet segments. The magnetic member 70 can vary in size and shape. In FIG. 14, the magnetic member 70 is shown as a single, rectangularly shaped magnet which easily fits into the recess 66 formed in the base 54. Alternatively, the magnetic member 70 can be positioned on or above the upper surface 58 of the base 54' and is contained in the hollow area 30 of the tray 14.

The magnetic member 70 can be a flexible magnet or a non-flexible magnet. When the magnetic member 70 is a strip of magnetic material, it can have a length $I_1$, measured parallel to the longitudinal central axis $X_4$-$X_4$. The length $I_1$ of the magnetic member 70 can vary. Desirably, the length $I_1$ of the magnetic member 70 should be approximately equal to the length I of the recess 66 into which it can be positioned. When the magnetic member 70 is a single elongated strip, it should have a length $I_1$ of at least about 4 inches, desirably, at least about 5 inches, and more desirably, at least about 6 inches. The length $I_1$ of the magnetic member 70 will increase as the overall length of the magnetic storage device 10 increases. The magnetic member 70 also has a width $w_1$ which can also vary. The width $w_1$ of the magnetic member 70 can range from between about 0.3 inches to about 2 inches. Desirably, the width $w_1$ of the magnetic member 70 ranges from between about 0.5 inches to about 1.5 inches. More desirably, the width $w_1$ of the magnetic member 70 ranges from between about 0.75 inches to about 1.25 inches. The magnetic member 70 has a thickness $t_2$ which can also vary. The thickness $t_2$ of the magnetic member 70 can range from between about 0.01 inches to about 0.5 inches. Desirably, the thickness $t_2$ of the magnetic member 70 ranges from between about 0.05 inches to about 0.3 inches. More desirably, the thickness $t_2$ of the magnetic member 70 ranges from between about 0.1 inches to about 0.25 inches.

The magnetic member 70 can be positioned in the hollow area 30 of the tray 14 before the base 54 or 54' is secured to the tray 14. Alternatively, the magnetic member 70 can be positioned in the recess 66 and then the base 54 can be secured to the tray 14.

The magnetic member 70 can be purchased from a variety of commercial vendors. One such company that sells magnets is Bunting Magnetic Company of Newton, Kans. The magnetic member 70 can be formed from any suitable magnet material, including ceramic, metallic and flexible magnetic materials. The magnetic member 70 can be a discrete ceramic or ferrite elements in a discoidal or substantially rectangular shape. Alternatively, the magnetic member 70 can be cut from a magnetic sheet into one or more smaller shapes and sizes to form a series of discrete magnets.

The magnetic member 70 can also be formed from a homogeneous material which is magnetized with one pole along one surface and an opposite pole along an opposite surface to form north-south regions. Likewise, the magnetic member 70 can be formed from a conventional flexible magnet of the sort having magnetizable barium ferrite particles dispersed in a rubbery matrix. Such materials are available from Arnold Engineering Company and RJF International Corporation. The magnetic member 70 can further be formed from a suitable powdered metallic material such as iron oxide.

The magnetic member 70 can be held in place in any suitable manner. For example, the magnetic member 70 can be secured to the recess 66 or to the upper surface 58 of the base 54' by a glue, an adhesive, by an epoxy, by a silicone or a cyanoacrylate adhesive, or by some other adhesive known to those skilled in the adhesive art. Alternatively, the magnetic member 70 could be inserted into the recess 66 and be loosely held in place or be held in place by a tight fit or by a friction fit. Still further, the magnetic member 70 could be secured to the base 54 or 54' by a mechanical device. Desirably, the magnetic member 70 will be stationary within the hollow area 30 once the base 54 or 54' is secured to the tray 14.

The magnetic member 70 can produce a magnetic flux. The magnetic flux yieldably holds the plurality of products 12 in position within their respective cavities 42 so that the user must exert a slight force in order to remove each of the products 12 from its storage cavity 42. In this manner, vibration or jarring of the magnetic storage device 10 will not cause the plurality of products 12 to dislodge from the cavities 42. The magnetic member 70 allows a person, such as a mechanic, to remove and/or replace products 12 from and into the magnetic storage device 10 using only one hand. The magnetic storage device 10 facilitates the utilization of a set of tools, such as socket heads (products 12), especially when the mechanic is in an awkward position such that a one-handed operation is essential.

The magnetic member 70 exerts a sufficient magnetic attraction on the plurality of products 12 when each is inserted into one of the cavities 42 to temporarily retain the plurality of products 12 therein. The magnetic member 70 exerts a sufficient magnetic attraction such that the products 12 will be retained in the cavities 42 even when the magnetic storage device 10 is placed at a steep angle or is inverted (turned upside down). The magnetic member 70 also simultaneously exerts a sufficient magnetic attraction through the lower surface 56 of the base 54 or 54' to releasably attach the magnetic storage device 10 to a magnetically attractive surface. The magnetic member 70 will secure the magnetic storage device 10 to any ferrous metallic surface, such as a metallic work bench or shelf, a motor vehicle, or any other suitable location. For example, the magnetic storage device 10 can be used by a mechanic working in the engine compartment of a motor vehicle. The magnetic storage device 10 can be magnetically attached to a magnetically attractive metal surface of the vehicle. The orientation of the magnetic storage device 10 is not important since it can be attached to a metal surface of the vehicle even while inverted or on its side. The placement of the magnetic storage device 10 close to the area being worked upon increases the efficiency of the mechanic and generally makes the job a lot easier.

There may also be times when a mechanic does not know the exact diameter of a particular socket wrench head which is needed to fit onto the head of a bolt which is to be removed or tightened. In this situation, the mechanic will try to match up a socket wrench head to test the size of the bolt. The mechanic may have to try two or three socket wrench heads before he finds the correct diameter. Having the magnetic storage device 10 located adjacent to his work area will make this whole process quicker and more efficient. The mechanic will not be required to reach for another socket wrench head which may be located several feet away.

Referring to FIGS. 15 -18, the magnetic storage device 10 can further include a cover 72. The cover 72 is a 3-dimensional structure having a longitudinal central axis $X_5$-$X_5$, a transverse central axis $Y_5$-$Y_5$, and a vertical central axis $Z_5$-$Z_5$. The cover 72 is sized and shaped to be removably attached to the tray 14. In other words, the cover 72 can be secured or attached to the tray 14 and can be removed from the tray 14. The cover 72 can be attached and removed from the tray 14 multiple times. Desirably, the cover 72 is tightly fitted or is friction fitted onto the outer periphery 38 of the plateau 34 such that it is vertically positioned over the tray 14. When the cover 72 is secured to the tray 14, the plurality of products 12 positioned in each of the cavities 42 will be completely covered. When the cover 72 is removed or separated from the tray 14, the plurality of products 12 will be exposed and can be individually removed from the cavities 42.

The cover 72 can be formed from any material. Desirably, the cover 72 is formed or constructed from a clear plastic material such that it is transparent. By "transparent" it is meant capable of transmitting light so that objects or images can be seen as if there were no intervening material. The cover 72 can be injection molded into a 3-dimensional structure. The cover 72 has a lower surface 74, an upper surface 76, and a sidewall 78 that extends between the lower and upper surfaces, 74 and 76 respectively. The lower surface 74 has a hollow cavity 80 formed therein, see FIG. 18. The hollow cavity 80 has an interior periphery 82 which is sized and configured to engage with the outer periphery 38 of the plateau 34 and secure the cover 72 to the tray 14. When so attached, the lower surface 74 of the cover 72 will contact a portion of the tray 14.

Figure 15:
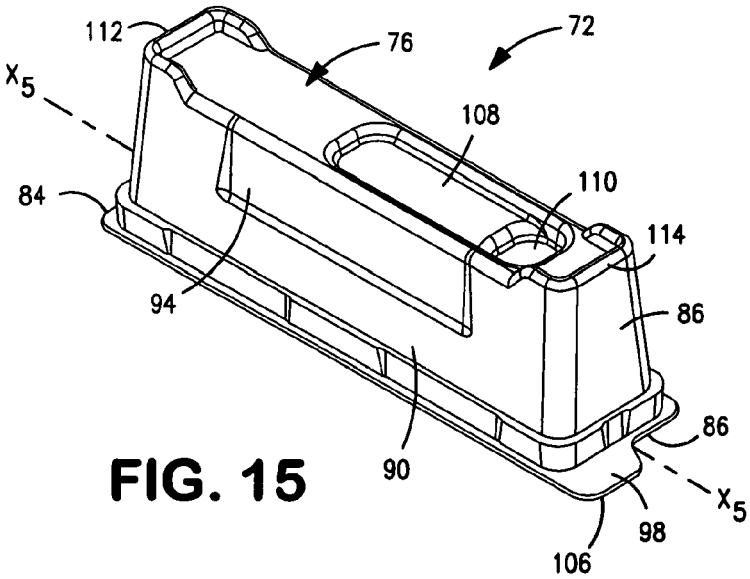
FIG. 15 is a perspective view of a transparent cover.

As shown in FIG. 15, the cover 72 has a generally rectangular shape when viewed from above. The cover 72 has a first end 84, a second end 86, a first side 88 and a second side 90. Each of the first and second sides, 88 and 90 respectively, has an indent, 92 and 94 respectively, formed therein approximate the vertical central axis $Z_5$-$Z_5$. The pair of indents 92 and 94 enables a human hand to easily grasp the cover 72 and press it down onto the tray 14. In other words, it only takes one hand to attach the cover 72 to the tray 14. The pair of indents 92 and 94 is separated by a distance of less than about 3 inches when measured along the transverse central axis $Y_5$-$Y_5$. Desirably, the pair of indents 92 and 94 is separated by a distance of less than about 2.5 inches when measured along the transverse central axis $Y_5$-$Y_5$. More desirably, the pair of indents 92 and 94 is separated by a distance of less than about 2 inches when measured along the transverse central axis $Y_5$-$Y_5$.

Referring again to FIGS. 15, 16 and 18, one can see that the first and second ends, 84 and 86 respectively, of the cover 72 have an arcuate or non-linear design. Approximately half the width of each of the ends 84 and 86 extends outward in the form of a finger tab, 96 and 98 respectively. The finger tab 96 extends outward from the remainder of the first end 84 and parallel to the longitudinal central axis $X_5$-$X_5$ while the finger tab 98 extends outward from the second end 86 and parallel to the longitudinal central axis $X_5$-$X_5$.

Referring again to FIGS. 1 and 4, the finger tabs 84 and 86 are constructed in the cover 72 such that they are offset from the finger tabs 50 and 52 formed in the tray 14, when viewed along the transverse central axis Y-Y of the magnetic storage device 10. The finger tabs 50 and 52 and 84 and 86 function to provide an easy means for separating the cover 72 from the tray 14. A person can grasp the finger tab 50 or 52 between his or her thumb and index finger on one hand and grasp the finger tab 96 or 98 between his or her thumb and index finger on his other hand. By pulling upward on the finger tab 96 or 98 and pushing downward on the finger tab 50 or 52, one can easily separate the cover 72 from the tray 14.

One will also notice in FIGS. 1-4, that a portion of the lower surface 56 of the base 54, a portion of the lower surface 24 of the tray 14, and a portion of the lower surface 74 of the cover 72 are contiguously aligned when the base 54, the tray 14 and the cover 72 are engaged. Furthermore, the first and second sides, 20 and 22 respectively, of the tray 14 can be conterminous with the first and second sides, 88 and 90 respectively, of the cover 72, when the cover 72 is secured to the tray 14. By "conterminous" it is meant sharing a boundary; contiguous.

Figure 4:
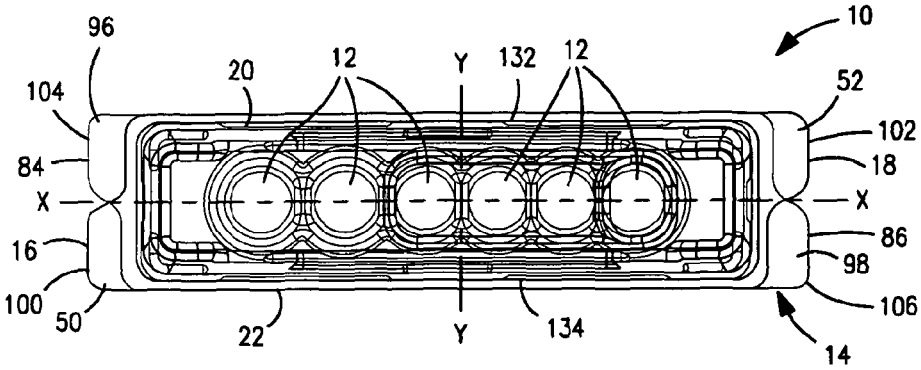
FIG. 4 is a top view of the magnetic storage device shown in FIG. 1.

Still referring to FIG. 4, one will notice that a portion of each of the first and second ends, 84 and 86 respectively, of the cover 72 extend outward beyond a portion of the first and second ends, 16 and 18 respectively, of the tray 14. Furthermore, the finger tab 50 has an outer edge 100 and the finger tab 52 has an outer edge 102. Likewise, the finger tab 96 has an outer edge 104 and the finger tab 98 has an outer edge 106. The outer edge 100 of the finger tab 50 is aligned with the outer edge 104 of the finger tab 96, measured along the transverse central axis Y-Y, when the cover 72 is secured to the tray 14. Likewise, the outer edge 102 of the finger tab 52 is aligned with the outer edge 106 of the finger tab 98, measured along the transverse central axis Y-Y, when the cover 72 is secured to the tray 14.

Figure 16:
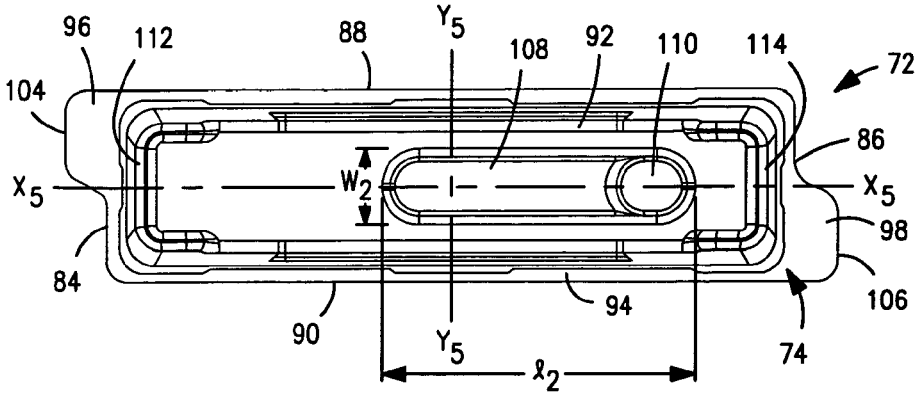
FIG. 16 is a top view of the transparent cover shown in FIG. 15.
Figure 17:
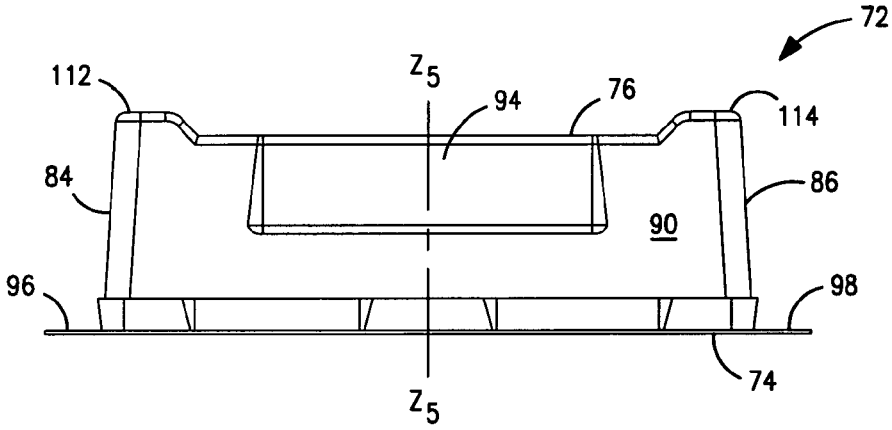
FIG. 17 is a side view of the transparent cover shown in FIG. 15.
Figure 18:
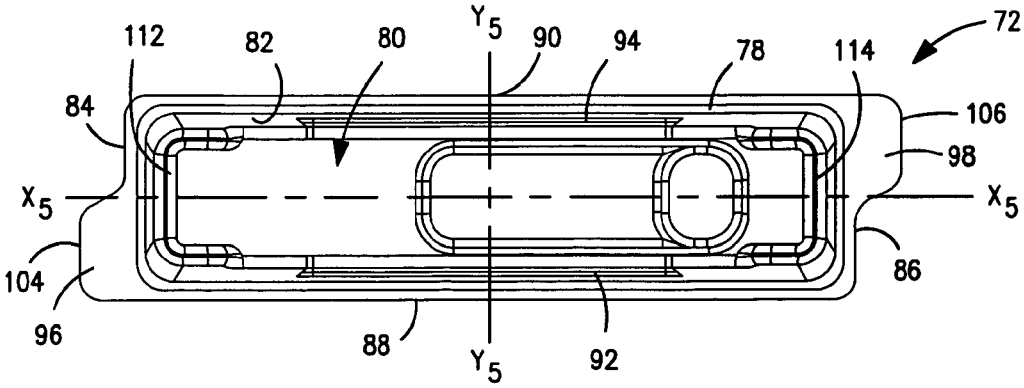
FIG. 18 is a bottom view of the transparent cover shown in FIG. 15.

Referring again to FIGS. 15 and 16, the upper surface 76 of the cover 72 contains a depression 108. By "depression" it is meant an area that is sunk below its surroundings; a hollow. The depression 108 can vary in configuration. The depression 108 is depicted as having a racetrack profile with a length $I_2$ and a width $w_2$. The length $I_2$ and the width $w_2$ of the depression 108 can vary. Typically, the length $I_2$ is greater than the width $w_2$. The depression 108 also has a depth that can be constant throughout its length $I_2$ or can vary along its length $I_2$. The depth can range from between about 0.01 inches to about 3 inches depending upon the overall length $I_2$ of the cover 72. Desirably, the depth can range from between about 0.01 inches to about 1 inch. The depression 108 extends downward towards the lower surface 74 of the cover 72. The depression 108 is vertically aligned, as measured along the vertical central axis $Z_5$-$Z_5$, with one or more of the cavities 42 formed in the tray 14. The depression 108 can have one or more portions which have a deeper depth. As depicted in FIGS. 15 and 16, a portion 110 of the depression 108 has a deeper depth than the remaining portion. The deeper depth portion 110 is situated on the right side of the depression 108 and is aligned closer to the second end 86. However, the deeper depth portion 110 can be located anywhere along the length $I_2$ of the depression 108.

Figure 2:
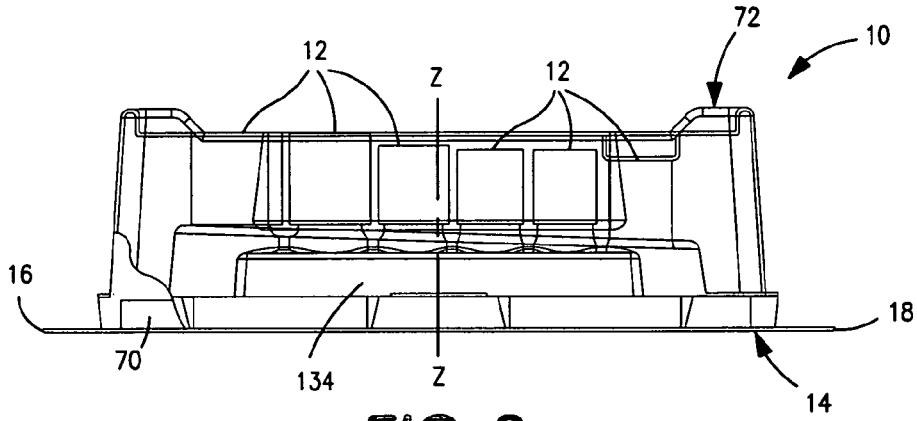
FIG. 2 is a side view of the magnetic storage device shown in FIG. 1.
Figure 3:
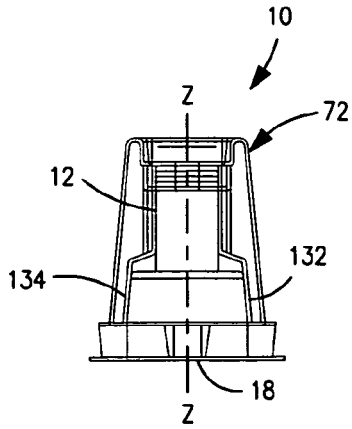
FIG. 3 is an end view of the magnetic storage device shown in FIG. 1.

Referring again to FIGS. 1-3, one can see that the depression 108 and any deeper depth portions 110 function to assist in retaining one or more of the plurality of products 12 in their respective cavities 42. As best seen in FIG. 2, the deeper depth portion 110 will assist in retaining the shortest product 12, which is depicted as being located closest to the second end 18 of the tray 14, in its cavity 42. The remainder of the depression 108 will assist in retaining the next three products 12 in their respective cavities. The two tallest products 12, those depicted as being located adjacent to the first end 16 of the tray 14, will be retained in their respective cavities 42 by the upper surface 76 of the cover 72. It should be understood that if all the products 12 are of the same height, that the depressions 108 and 110 may not be needed. Alternatively, the depression 108 could extend lengthwise, parallel to the longitudinal central axis $X_5$-$X_5$, along the upper surface 76 of the cover 72 and the depth of the depression 108 can taper downward along its length $I_2$.

Referring again to FIGS. 15-18, the cover 72 further contains a pair of upwardly extending shoulders 112 and 114. The pair of shoulders 112 and 114 is located adjacent to the first and second ends, 84 and 86 respectively, of the cover 72. The pair of shoulders 112 and 114 is shown wrapping around and extending along a portion of the first and second sides, 88 and 90 respectively. However, the pair of shoulders 112 and 114 does not have to extend along a portion of the first and/or second sides, 88 and/or 90 respectively. Furthermore, the pair of shoulders 112 and 114 could extend along the entire first and second sides, 88 and 90 respectively, so as to form a ridge around the entire upper surface 76. The pair of shoulders 112 and 114 can be formed as part of the cover 72 and can be integral with the cover 72. The pair of shoulders 112 and 114 can vary in height. Desirably, each of the pair of shoulders 112 and 114 will extend upward above the upper surface 76 of the cover 72 for a distance from between about 0.1 to about 0.5 inches. More desirably, each of the pair of shoulders 112 and 114 will extend upward above the upper surface 76 for a distance from between about 0.15 to about 0.35 inches. Desirably, each of the pair of shoulders 112 and 114 are of the same height but they do not have to be.

The pair of shoulders 112 and 114 is sized, arranged and configured to engage with and mate in a portion of the channel 68 formed in the lower surface 56 of the base 54. Desirably, the distance that each of the pair of shoulders 112 and 114 extends upward above the upper surface 76 of the cover 72 is equal to or less than the depth of the channel 68. The pair of shoulders 112 and 114 can form a loose fit, a snug fit or a tight interference fit with the base 54. Desirably, the pair of shoulders 112 and 114 will form a snug fit with the base 54. The pair of shoulders 112 and 114 enables one of the magnetic storage devices 10 to be positioned on and held secure to the base 54 of another magnetic storage device 10. This stacking or nesting arrangement is shown in FIG. 19. It should be understood that two or more of the magnetic storage devices 10 can be stacked vertically, one on top of another. Such stacking will reduce packing space, possibly reduce shipping cost, and can facilitate display of the magnetic storage devices 10 on a store shelf when they are being offered for sale. The number of magnetic storage devices 10 that can be stacked vertically can vary. However, three to ten magnetic storage devices 10 can easily be stacked in a secure fashion.

Figure 20:
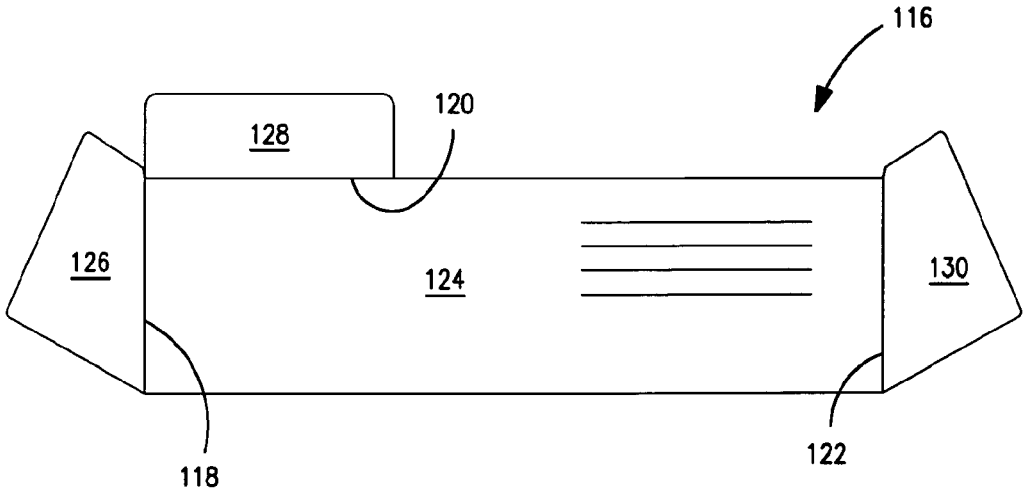
FIG. 20 is an assembly view showing a pair of the magnetic storage devices stacked one on the other in a nested arrangement.

Referring now to FIG. 20, an advertising card 116 is shown which can be formed from a variety of materials. For example, the advertising card 116 can be formed from paper, paperboard, stiff paper, cardboard, plastic, etc. The advertising card 116 can be white in color or contain one or more colors. The advertising card 116 can contain one or more letters, words, numbers, symbols, images, graphics, photos, etc. The words, numbers, symbols, etc. can be written or printed on one or both sides of the advertising card 116. Desirably, the advertising card 116 is printed on both sides.

The advertising card 116 is shown having three fold lines 118, 120 and 122. The actual number of fold lines present can vary. The advertising card 116 is designed to be folded along the three fold lines 118, 120 and 122 before being inserted into the hollow cavity 80 of the cover 72. When the advertising card 116 is folded along the three fold lines 118, 120 and 122, four sections 124, 126, 128 and 130 are created. The section 124 is the largest section, the sections 126 and 130 are located on opposite ends of the largest section 124, and the section 128 is located above the largest section 124. The folded advertising card 116 is easily inserted into and positioned in the hollow cavity 80 of the cover 72. When positioned in the hollow cavity 80, the largest section 124 can be positioned adjacent to the inside surface of the first side 88, the sections 126 and 130 can be positioned adjacent to the inside surface of the first and second ends, 84 and 86 respectively, and the section 128 is positioned adjacent to the top inside surface. The advertising card 116 can be fitted by friction into the hollow cavity 80 of the cover 72. Alternatively, the advertising card 116 can be snap-fitted into the hollow cavity 80, or be sized to form an interference fit with the hollow cavity 80. These and other ways of positioning and holding the advertisement card 116 in the hollow cavity 80 will be apparent to those skilled in the art and are considered a part of this invention.

The friction, interference or snap-fit will allow the advertising card 116 to remain in place as the cover 72 is secured to and removed from the tray 14. The advertising card 116 can be discarded by the buyer after the magnetic storage device 10 is purchased.

The advertising card 116 can contain information which identifies the plurality of products 12 stored in the magnetic storage device 10. The advertising card 116 can also provide instructions as to how to use the plurality of products 12 stored in the magnetic storage device 10. Furthermore, the advertising card 116 can provide information as to the manufacturer or distributor of the magnetic storage device 10.

Referring again to FIGS. 1-8, it is possible for the manufacturer or distributor of the magnetic storage device 10 to include his name, the company's name, and/or a logo directly on the magnetic storage device 10. One likely place where such a name, company name and/or logo can be placed is on one or both of the flat surfaces 132 and 134 of the upwardly extending member 40 of the tray 14. The flat surfaces 132 and 134 are aligned opposite to one another. The flat surface 132 appears on the first side 20 of the tray 14 while the other flat surface 134 appears on the second side 22 of the tray 14. It is also possible for the manufacturer or distributor of the magnetic storage device 10 to include or place his name, the company's name, and/or a logo somewhere else on the magnetic storage device 10. It is also possible for the manufacturer or distributor of the magnetic storage device 10 to adhesively attach a label to the magnetic storage device 10.

Method

A method of assembling the magnetic storage device 10 will now be explained. The magnetic storage device 10 is capable of retaining a plurality of products 12, for example as a set. Each of the plurality of products 12 has a magnetic affinity. The method includes the steps of forming a tray 14 having a lower surface 24 with a hollow area 30, an upper surface 26, and a longitudinal central axis $X_1$-$X_1$. The upper surface 26 has a plateau 34 with an outer periphery 38 and an upwardly extending member 40 located completely within the outer periphery 38. The upwardly extending member 40 has one or more cavities 42 formed therein which are aligned along the longitudinal central axis $X_1$-$X_1$. Desirably, there is a plurality of cavities 42 formed in the upwardly extending member 40. Each of the cavities 42 extends downward towards the lower surface 24 and each of the cavities 42 has a configuration which enables one of the plurality of products 12 to be at least partially retained therein. The method also includes forming a base 54 having a lower surface 56 and an upper surface 58. At least a portion of the upper surface 58 engages with the tray 14 to completely enclose the hollow area 30. A magnetic member 70 is positioned within the hollow area 30. The method further includes aligning the base 54 with the tray 14 to allow the upper surface 58 of the base 54 to be secured to the tray 14. The base 54 cooperates with the tray 14 to enclose the magnetic member 70. For example, the base 54 can engage with the hollow area 30 to enclose the magnetic member 70.

The method can also include positioning each of the plurality of products 12 into one of the cavities 42 whereby the magnetic member 70 exerts a sufficient magnetic attraction on each of the plurality of products 12 to temporarily retain each therein. The magnetic member 70 also exerts a sufficient magnetic attraction through the lower surface 56 of the base 54 to releasably attach the magnetic storage device 10 to a magnetically attractive surface. The magnetically attractive surface can be any metal surface.

Lastly, the method can include the step of forming a cover 72 having a lower surface 74, an upper surface 76, and a sidewall 78 which extends between the lower and upper surfaces, 74 and 76 respectively. The lower surface 74 has a hollow cavity 80 formed therein with an interior periphery 82 which is sized and configured to engage with the outer periphery 38 of the plateau 34. The cover 72 can then be releasably secured to the tray 14.

While the invention has been described in conjunction with several specific embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. A magnetic storage device capable of retaining a plurality of products, each product having a magnetic affinity, said magnetic storage device comprising:

a) a tray having a lower surface having a hollow area, an upper surface, and a longitudinal central axis, said upper surface having a plateau with an outer periphery and an upwardly extending member located completely within said outer periphery, said upwardly extending member rising upward above said plateau and having at least two cavities formed therein which are aligned along said longitudinal central axis, each of said cavities extending downward towards said lower surface, and each of said cavities having a configuration which enables one of the plurality of products to be at least partially retained therein;

b) a base having a lower surface and an upper surface, at least a portion of said upper surface of said base engaging with said tray to completely enclose said hollow area; and c) a magnetic member positioned within said hollow area, said magnetic member exerting a sufficient magnetic attraction on the plurality of products when each is inserted into one of said cavities to temporarily retain the plurality of products therein, and said magnetic member exerting a sufficient magnetic attraction through said lower surface of said base to releasably attach said magnetic storage device to a magnetically attractive surface.

2. The magnetic storage device of claim 1 wherein each of said cavities has a sidewall which intersects with a sidewall of an adjacent cavity, and each of said intersecting sidewalls has an opening formed therein.

3. The magnetic storage device of claim 2 wherein each of said cavities has a closed bottom which is spaced above said lower surface of said tray, and each of said closed bottoms is aligned in a horizontal plane.

4. The magnetic storage device of claim 3 wherein said tray has a first end and a second end, and said at least two cavities include a first cavity and a second cavity, said first cavity being located adjacent to said first end and said second cavity being located adjacent to said second end, said first and second cavities each having a height with the height of said first cavity being greater than the height of said second cavity, and each of said first and second cavities having a circular cross-section of similar diameter.

5. The magnetic storage device of claim 1 further comprising a removable cover having a lower surface, an upper surface, and a sidewall extending between said lower and upper surfaces, said lower surface having a hollow cavity formed therein with an interior periphery which is sized and configured to engage with said outer periphery of said plateau and secure said cover to said tray.

6. The magnetic storage device of claim 5 wherein said cover is transparent plastic.

7. The magnetic storage device of claim 6 wherein said cover has a rectangular shape with a first end, a second end, a first side and a second side, and said first and second sides have an indent formed in said sidewalls which enables a human hand to easily grasp said cover.

8. The magnetic storage device of claim 5 wherein said upper surface of said cover contains a depression which extends downward towards said lower surface, said depression being vertically aligned with one of said cavities and assisting in retaining one of the plurality of products which is positioned in said one cavity.

9. The magnetic storage device of claim 5 wherein said removable cover is friction fitted onto said outer periphery of said plateau and a printed advertising card is inserted into said cover.

10. A magnetic storage device capable of retaining a plurality of products, each product having a magnetic affinity, said magnetic storage device comprising:

a) a tray having a lower surface having a hollow area with an interior periphery, an upper surface, and a longitudinal central axis, said upper surface having a plateau with an outer periphery and an upwardly extending member located completely within said outer periphery, said upwardly extending member having a plurality of cavities formed therein which are aligned along said longitudinal central axis, each of said plurality of cavities extending downward towards said lower surface, and each of said plurality of cavities having a configuration which enables one of the plurality of products to be at least partially retained therein;

b) a base having a lower surface and an upper surface, and a sidewall extending between said lower and upper surfaces, said sidewall cooperating with said upper surface to form an elevation having an outer periphery which is sized and configured to enable a portion of said upper surface to engage with said tray to completely enclose said hollow area, said base having a recess formed in said upper surface, and said base having a channel formed in said lower surface which completely surrounds said recess;

c) a cover having a lower surface, an upper surface, and a sidewall extending between said lower and upper surfaces, said lower surface having a hollow cavity formed therein with an interior periphery which is sized and configured to engage with said outer periphery of said plateau and secure said cover to said tray; and d) a magnetic member positioned within said hollow area, said magnetic member exerting a sufficient magnetic attraction on the plurality of products each inserted into one of said plurality of cavities to temporarily retain the plurality of products therein, and said magnetic member exerting a sufficient magnetic attraction through said lower surface of said base to releasably attach said magnetic storage device to a magnetically attractive surface.

11. The magnetic storage device of claim 10 wherein said upper surface of said cover is sized and configured to engage with said channel formed in another said magnetic storage device whereby said pair of magnetic storage devices can be stacked one upon another.

12. The magnetic storage device of claim 10 wherein said cover is removable from said tray and is formed from a transparent thermoplastic, and a display card containing advertisement is inserted into said cover and said advertisement can be easily read through said transparent thermoplastic.

13. The magnetic storage device of claim 10 wherein said tray and said cover each have a first end, a second end, a first side and a second side, and a portion of each of said first and second ends of said cover extend outward beyond said first and second ends of said tray.

14. The magnetic storage device of claim 13 wherein said upwardly extending member varies in height along said longitudinal central axis, and said cavity located closest to said first end of said tray has a depth which is greater than the depth of said cavity located closest to said second end of said tray.

15. The magnetic storage device of claim 10 wherein each of said plurality of cavities has a cross-sectional diameter, and the cross-sectional diameter of one of said plurality of cavities is different from said cross-sectional diameter of another one of said plurality of cavities.

16. The magnetic storage device of claim 10 wherein the plurality of products will be retained in said plurality of cavities even when said magnetic storage device is inverted.

17. The magnetic storage device of claim 10 wherein a portion of said lower surface of said base, a portion of said lower surface of said tray, and a portion of said lower surface of said cover are contiguous when said base, said tray and said cover are engaged.

18. A method of assembling a magnetic storage device which is capable of retaining a plurality of products, each product having a magnetic affinity, said method comprising the steps of:

a) forming a tray having a lower surface with a hollow area, an upper surface, and a longitudinal central axis, said upper surface having a plateau with an outer periphery and an upwardly extending member located completely within said outer periphery, said upwardly extending member rising upward above said plateau and having a plurality of cavities formed therein which are aligned along said longitudinal central axis, each of said cavities extending downward towards said lower surface, and each of said cavities having a configuration which enables one of the plurality of products to be at least partially retained therein;

b) forming a base having a lower surface and an upper surface, at least a portion of said upper surface of said base engaging with said tray to completely enclose said hollow area;

c) positioning a magnetic member within said hollow area; and d) aligning said base with said tray to allow said upper surface of said base to engage with said hollow area and enclose said magnetic member.

19. The method of claim 18 further comprising positioning each of the plurality of products into one of said plurality of cavities whereby said magnetic member exerts a sufficient magnetic attraction on each of the plurality of products to temporarily retain each therein, and said magnetic member exerts a sufficient magnetic attraction through said lower surface of said base to releasably attach said magnetic storage device to a magnetically attractive surface.

20. The method of claim 18 further comprising forming a cover having a lower surface, an upper surface, and a sidewall extending between said lower and upper surfaces, said lower surface having a hollow cavity formed therein with an interior periphery which is sized and configured to engage with said outer periphery of said plateau, and securing said cover to said tray.

* * * * *

UNITED STATES PATENT AND TRADEMARK OFFICE

CERTIFICATE OF CORRECTION

PATENT NO. : 7,837,033 B2
APPLICATION NO. : 12/384827
DATED : November 23, 2010
INVENTOR(S) : Thomas P. Schein et al.

It is certified that error appears in the above-identified patent and that said Letters Patent is hereby corrected as shown below:

On the title page, item number (74), "Wilhem" should be replaced with "Wilhelm".

In column 4, line 27, "a advertising" should be replaced with "an advertising".

In column 6, line 47, after "extending member 40", "and" should be removed.

In column 9, line 28, "se" should be replaced with "see".

In column 9, line 58, "ti" should be replaced with "$t_1$".

Signed and Sealed this
Fifth Day of April, 2011

David J. Kappos

David J. Kappos
*Director of the United States Patent and Trademark Office*